US011702775B2

(12) United States Patent
Liao

(10) Patent No.: US 11,702,775 B2
(45) Date of Patent: Jul. 18, 2023

(54) METHOD FOR FORMING ANTI-COUNTERFEITING FEATURE DURING KNITTING OF FABRIC AND FABRIC THEREOF

(71) Applicant: HENG SHENG INVESTMENT LTD., Tortola (VG)

(72) Inventor: Chih-Wen Liao, Taichung (TW)

(73) Assignee: HENG SHENG INVESTMENT LTD., Tortola (VG)

( * ) Notice: Subject to any disclaimer, the term of this patent is extended or adjusted under 35 U.S.C. 154(b) by 155 days.

(21) Appl. No.: 17/107,211

(22) Filed: Nov. 30, 2020

(65) Prior Publication Data

US 2022/0112635 A1 Apr. 14, 2022

(30) Foreign Application Priority Data

Oct. 8, 2020 (TW) ..... 109134988

(51) Int. Cl.
*D04B 1/22* (2006.01)
*D04B 21/20* (2006.01)

(52) U.S. Cl.
CPC ..... *D04B 1/22* (2013.01); *D04B 21/20* (2013.01); *D10B 2403/011* (2013.01)

(58) Field of Classification Search
CPC . D04B 1/22; D04B 21/20; D04B 1/10; D04B 1/126; D04B 7/26; D04B 9/28; D04B 9/42; D04B 11/20; D10B 2403/011; B42D 25/355
See application file for complete search history.

(56) References Cited

U.S. PATENT DOCUMENTS 951,033 A * 3/1910 Steber ..... D04B 1/10 66/200
4,355,499 A * 10/1982 Takai ..... D02G 1/085 57/208
4,527,383 A * 7/1985 Bingham ..... G09F 3/00 57/259
4,756,557 A * 7/1988 Kaule ..... G07D 7/04 283/85
4,891,958 A * 1/1990 Cournoyer ..... D04B 1/104 66/196
6,073,468 A * 6/2000 Wallace ..... D04B 1/10 66/202

(Continued)

*Primary Examiner* — Danny Worrell
(74) *Attorney, Agent, or Firm* — Muncy, Geissler, Olds & Lowe, P.C.

(57) ABSTRACT

A method for forming an anti-counterfeiting feature during knitting of a fabric and a fabric thereof, the fabric is knitted with at least one first yarn, a part of the fabric includes a plurality of featured yarn loops formed by a second yarn, the featured yarn loops constitute an anti-counterfeiting feature, the anti-counterfeiting feature can be directly observed from one side surface of the fabric, the second yarn is formed by twisting at least two sub-yarns with different shades, and shades of the at least two sub-yarns and the first yarn are different from each other, and a shade of the featured yarn loops displayed on the side surface is random. Accordingly, the randomness of yarn twisting makes the anti-counterfeiting feature difficult to be replicated, thereby preventing unscrupulous manufacturers from counterfeiting the fabric.

20 Claims, 4 Drawing Sheets

(56) References Cited

U.S. PATENT DOCUMENTS

| | | | | |
|---|---|---|---|---|
| 6,098,392 | A * | 8/2000 | Tung | D02G 3/346 57/58.3 |
| 6,482,512 | B1 * | 11/2002 | Schwartz | D02G 3/346 428/399 |
| 6,592,716 | B1 * | 7/2003 | Kim | D21H 15/04 162/146 |
| 7,575,027 | B2 * | 8/2009 | Huang | D03D 13/00 139/420 R |
| 8,445,392 | B2 * | 5/2013 | Rosset | D21F 9/043 442/310 |
| 9,644,291 | B1 | 5/2017 | Kuo | |
| 10,822,728 | B2 * | 11/2020 | Meir | D04B 1/126 |
| 10,900,149 | B2 * | 1/2021 | Meir | A43B 1/04 |
| 11,566,353 | B2 * | 1/2023 | Rose | D04B 1/22 |
| 2008/0107875 | A1 * | 5/2008 | Rosset | D21H 27/00 162/108 |
| 2009/0311527 | A1 * | 12/2009 | Seo | D21H 21/40 428/374 |
| 2015/0329996 | A1 * | 11/2015 | Hahm | D02G 3/44 428/221 |
| 2016/0108566 | A1 * | 4/2016 | Tseng | D04B 1/126 66/196 |
| 2016/0206039 | A1 * | 7/2016 | Cross | A43B 23/0245 |
| 2021/0348308 | A1 * | 11/2021 | Kestner | D02J 13/005 |
| 2022/0297391 | A1 * | 9/2022 | Coupe | B29B 11/16 |

* cited by examiner

METHOD FOR FORMING ANTI-COUNTERFEITING FEATURE DURING KNITTING OF FABRIC AND FABRIC THEREOF

FIELD OF THE INVENTION

The invention relates to a method for producing an anti-counterfeiting feature on a fabric and a fabric thereof, and more particularly to a method for forming an anti-counterfeiting feature via a fabric structure during knitting of a fabric and a fabric thereof.

BACKGROUND OF THE INVENTION

According to investigation, counterfeiting is rampant in the fabric market. At the same time, it is more likely to happen in the fabric market that a quantity of genuine products outflowed from OEMs exceeding an authorized quantity, which affects the revenue and goodwill of brand owners and sale agents. Therefore, brand owners and sale agents are committed to attach the anti-counterfeiting label or logo on fabrics for consumers to identify the authenticity.

In addition, in the current market, after a fabric is knitted, brand owners or sale agents further attach anti-counterfeiting identification tags on the fabric. However, it is still difficult to eradicate counterfeit fabrics produced by unscrupulous manufacturers on their own with the traditional anti-counterfeiting method of attaching an additional anti-counterfeiting identification tag thereon. Specifically, since conventional fabrics are easily counterfeited, it is still possible for unscrupulous manufacturers in the past to knit counterfeit fabrics and then attach anti-counterfeiting identification tags on the counterfeit fabrics in an attempt to confuse the genuine product with the counterfeit.

SUMMARY OF THE INVENTION

A main object of the invention is to solve the problem that the anti-counterfeiting method used in conventional fabrics is still easy to be counterfeited.

A secondary object of the invention is to solve the process problem that the conventional fabrics require additional processing for attaching the anti-counterfeiting tags on the fabric.

In order to achieve the above objects, the invention provides a method for forming an anti-counterfeiting feature during knitting of a fabric comprising steps of:

knitting with at least one first yarn to produce a fabric by a knitting machine;

feeding a second yarn when the knitting machine knitting to a position where the anti-counterfeiting feature is predetermined to form on the fabric, wherein the second yarn is formed by twisting at least two sub-yarns with dissimilar shades, and shades of the at least two sub-yarns and the first yarn are not similar to each other, and wherein a plurality of featured yarn loops formed by the second yarn is observed on one side surface of the fabric at the position to constitute the anti-counterfeiting feature, and a shade of the plurality of featured yarn loops displayed on the side surface is random; and stopping to feed the second yarn and continuing to knit with the first yarn to produce the fabric when the knitting machine knitting beyond the position where the anti-counterfeiting feature is predetermined to form on the fabric.

In one embodiment, the at least two sub-yarns belong to a same shade hue of a natural shade system and are at least three shade levels apart.

In one embodiment, the at least two sub-yarns respectively belong to different two shade hues of a natural shade system, a shade hue angle is formed between the two shade hues, and wherein the shade hue angle is greater than or equal to 30 degrees.

In one embodiment, shades of the at least two sub-yarns are not absolute white, absolute black, or gray mixed with absolute black and absolute white in proportion.

In one embodiment, the at least two sub-yarns are not reflective yarns.

In one embodiment, the at least one first yarn and the at least two sub-yarns belong to the same shade hue of the natural shade system, and the at least one first yarn and the at least two sub-yarns are separated by at least three sahde levels respectively.

In one embodiment, the at least one first yarn belongs to a shade hue of the natural shade system, which is different from the same shade hue of the at least two sub-yarns, a shade hue angle is formed between two shade hues, and the shade hue angle is greater than or equal to 30 degrees.

In one embodiment, a width of the anti-counterfeiting feature is greater than or equal to 1 inch.

In one embodiment, a needle pitch setting range of the knitting machine is set between 5 G and 20 G.

In one embodiment, the plurality of featured yarn loops are arranged to form at least one straight strip pattern on the fabric.

In addition to the foregoing, the invention further provides a fabric formed with an anti-counterfeiting feature during knitting, wherein the fabric is knitted with at least one first yarn, a part of the fabric includes a plurality of featured yarn loops formed by a second yarn, the plurality of featured yarn loops constitutes the anti-counterfeiting feature, which is directly observed from one side surface of the fabric, the second yarn is formed by twisting at least two sub-yarns with dissimilar shades, and shades of the at least two sub-yarns and the first yarn are not similar to each other, and a shade of the plurality of featured yarn loops displayed on the side surface is random.

In one embodiment, the at least two sub-yarns belong to a same shade hue of a natural shade system and are at least three shade levels apart.

In one embodiment, the at least two sub-yarns respectively belong to different two shade hues of a natural shade system, a shade hue angle is formed between the two shade hues, and wherein the shade hue angle is greater than or equal to 30 degrees.

In one embodiment, shades of the at least two sub-yarns are not absolute white, absolute black, or gray mixed with absolute white and absolute black in proportion.

In one embodiment, the at least two sub-yarns are not reflective yarns.

In one embodiment, when the at least one first yarn and the at least two sub-yarns belong to a same shade hue of a natural shade system, and the at least one first yarn and the at least two sub-yarns are separated by at least three shade levels respectively.

In one embodiment, the at least one first yarn belongs to a shade hue of the natural shade system, which is different from the same shade hue of the at least two sub-yarns, a shade hue angle is formed between two shade hues, and the shade hue angle is greater than or equal to 30 degrees.

In one embodiment, a width of the anti-counterfeiting feature is greater than or equal to 1 inch.

In one embodiment, a width of each of the plurality of featured yarn loops displayed on the side surface is greater than or equal to 1 mm.

Accordingly, compared with the prior art, the invention has the following features: the invention forms the anti-counterfeiting feature directly on the fabric during knitting, and through shade changes randomly on the yarn loops forming the anti-counterfeiting feature, the fabric is difficult to be counterfeited.

BRIEF DESCRIPTION OF THE DRAWINGS

The patent or application file contains at least one drawing executed in shades.

DETAILED DESCRIPTION OF THE PREFERRED EMBODIMENTS

Figure 1:
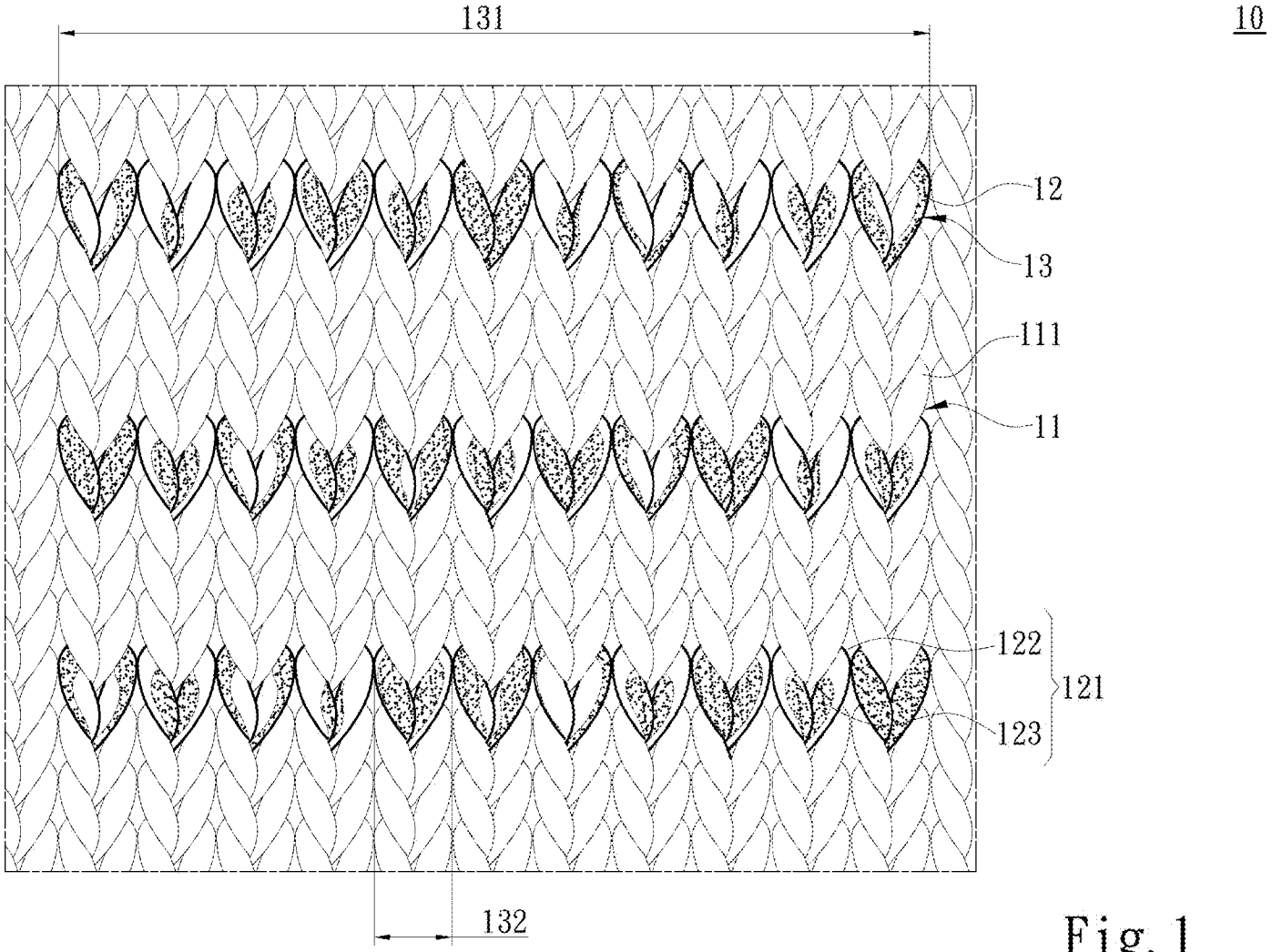
FIG. 1 is a schematic diagram of a fabric of one embodiment of the invention.

The detailed description and technical content of the invention are described below with reference to the drawings.

Please refer to FIG. 1, FIG. 2, FIG. 3, and FIG. 4. The invention provides a method 70 for forming an anti-counterfeiting feature during knitting and a fabric 10 thereof. In order to facilitate the understanding, the fabric 10 is described first. The fabric 10 can be used to manufacture a garment, a shoe or a bag. The fabric 10 is basically knitted by a knitting machine (not shown in the figures), which can be a warp knitting machine or a weft knitting machine, wherein the weft knitting machine can further be a circular weft knitting machine or a flat weft knitting machine. In detail, the fabric 10 includes a plurality of yarn loops 11 and a plurality of featured yarn loops 12 located on part of the fabric 10. The plurality of yarn loops 11 is formed by knitting at least one first yarn 111, and the plurality of featured yarn loops 12 is formed with a second yarn 121. The plurality of featured yarn loops 12 constitutes an anti-counterfeiting feature 13, which can be directly observed from one side surface of the fabric 10.

In one embodiment, the at least one first yarn 111 is composed of a plurality of yarns, or is formed by twisting a plurality of yarns. The second yarn 121 is formed by twisting at least two sub-yarns 122, 123, so that after the plurality of featured yarn loops 12 is knitted with the second yarn 121, a shade of each of the featured yarn loops 12 displayed on one side surface of the fabric 10 is not fixed but random. Taking FIG. 1 as an example, one of the two sub-yarns 123 (122) is represented by dotted patterns, and the other of the two sub-yarns 122 (123) is not represented by dotted patterns. After the two sub-yarns 122, 123 are twisted, the dot patterns of the plurality of featured yarn loops 12 on one side surface of the fabric 10 are distributed in random. In other words, a shade of one of the featured yarn loops 12 can be solely presented by one of the two sub-yarns 122 (123), or be randomly generated by the two sub-yarns 122, 123.

Accordingly, a shade of the plurality of featured yarn loops 12 exposed on one side surface of the fabric 10 of the invention varies randomly, such that anti-counterfeiting features on different fabrics are all different. Thereby the invention prevents others from imitating anti-counterfeiting features, and further preventing others from counterfeiting fabrics.

Figure 2:
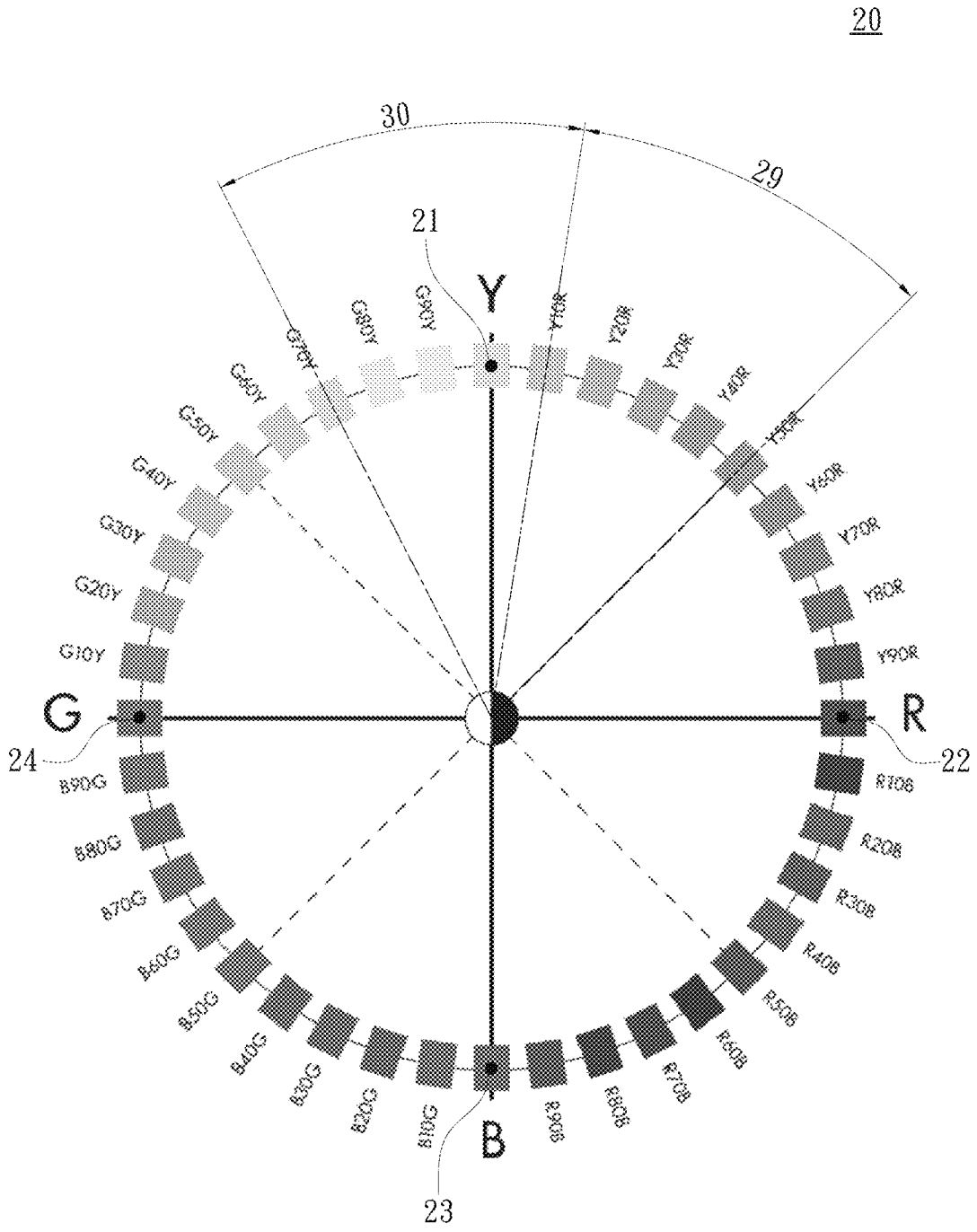
FIG. 2 is a schematic diagram of a shade circle of natural shade system (NCS) of one embodiment of the invention.
Figure 3:
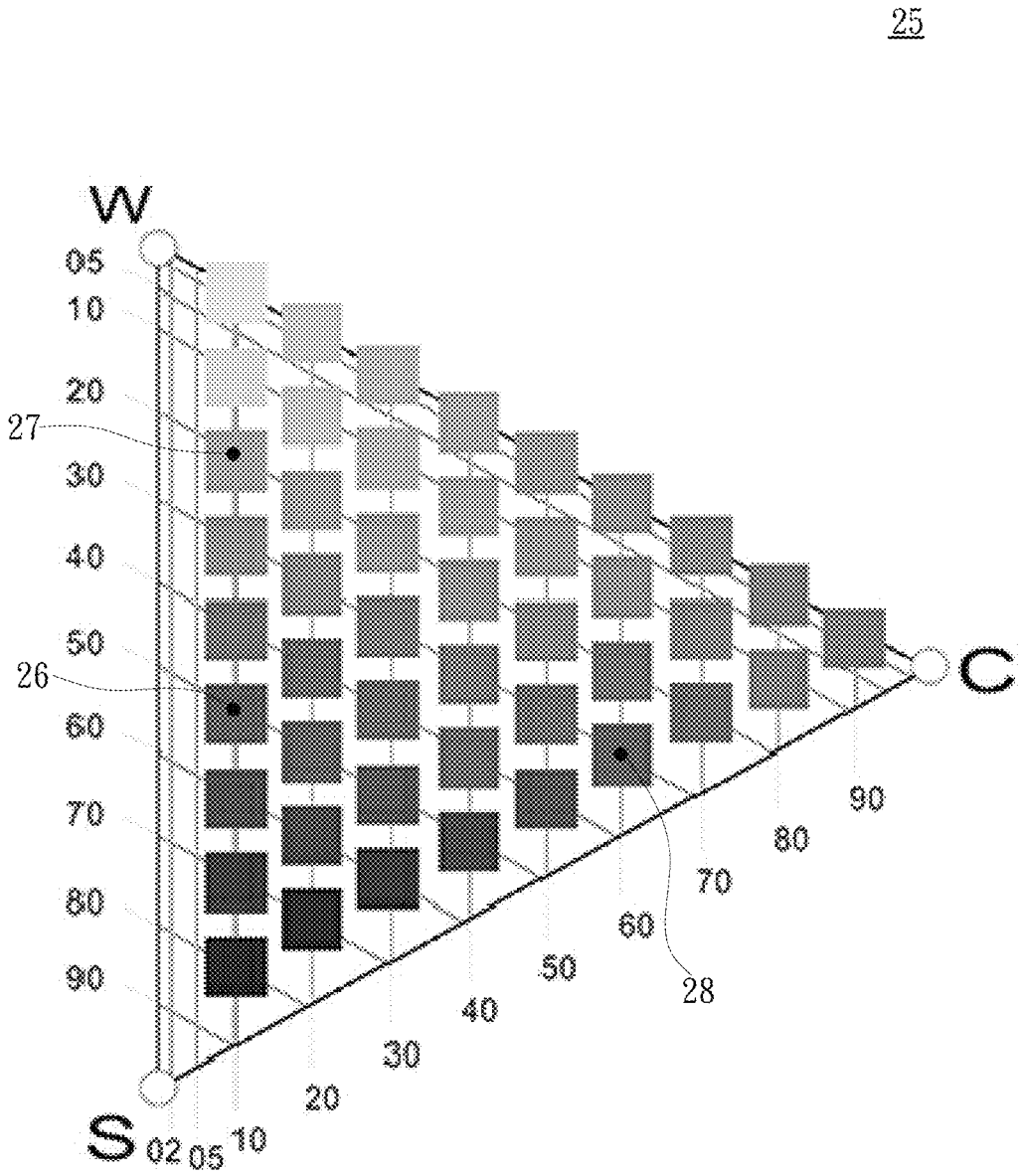
FIG. 3 is a schematic diagram of a shade triangle of NCS of one embodiment of the invention.
Figure 4:
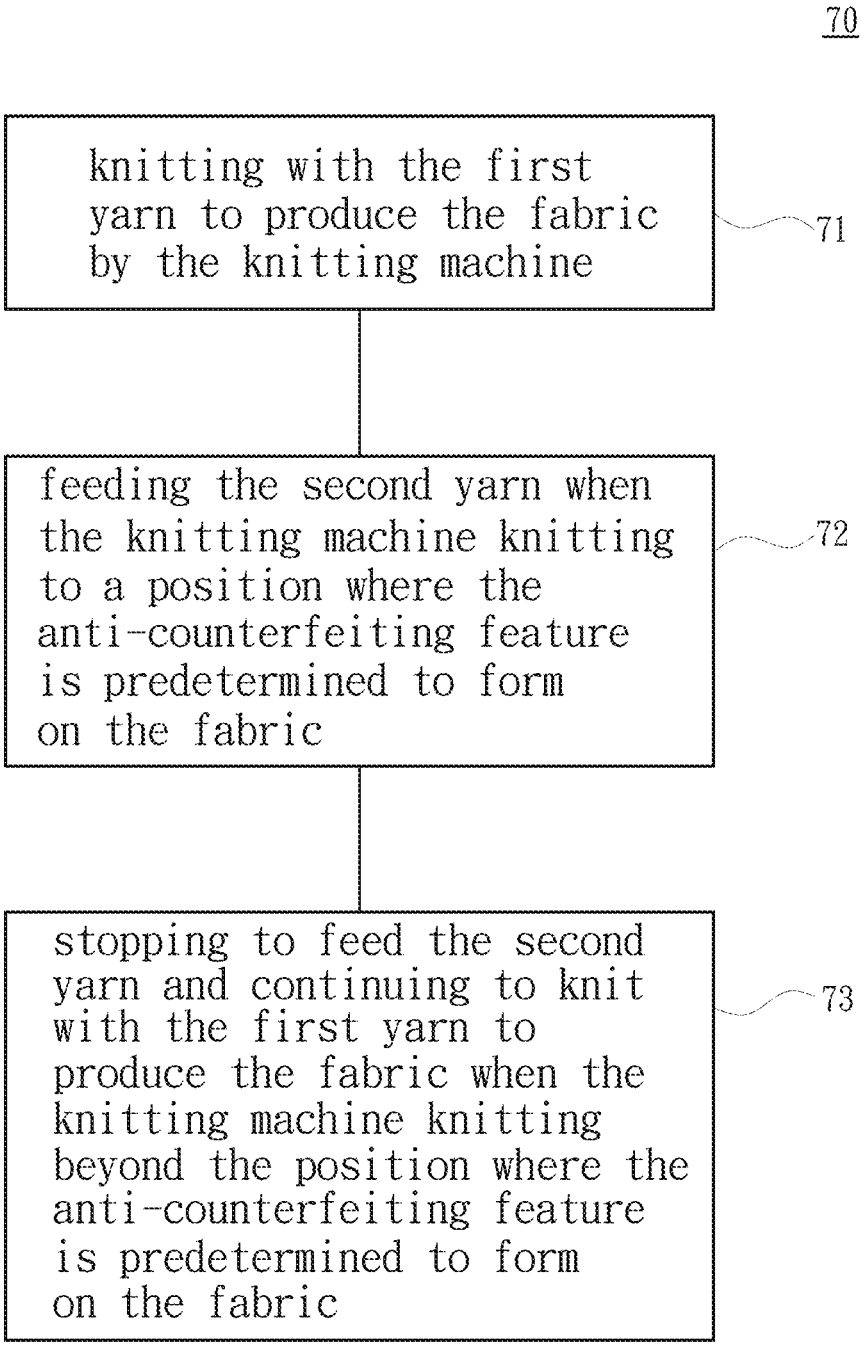
FIG. 4 is a flowchart of one embodiment of the invention.

In one embodiment, in order to make the anti-counterfeiting feature 13 more obvious, shades of the two sub-yarns 122, 123 and the first yarn 111 are not close to each other. To be more specific, the Natural Sahde System (NSS) is further used to explain the aforementioned differences. In one embodiment, if the two sub-yarns 122, 123 belong to a same shade hue in the NSS, the two sub-yarns 122, 123 need to be separated by at least three shade levels. Specifically, as shown in FIG. 2 and FIG. 3, a shade circle 20 of the NSS is formed by yellow 21, red 22, blue 23 and green 24 as four elementary shades of the NSS; and FIG. 3 illustrates a shade triangle 25 of the NSS that presents one shade hue in the shade circle 20. Here, the two sub-yarns 122, 123 belong to Y90R hue of the NSS. Then, if a shade level of one of the two sub-yarns 122 (123) is selected to be in S1050 shade level (indicated as reference 26) in the shade triangle 25 defined by Y90R hue of the shade circle 20, a shade level of the other one of the two sub-yarns 123 (122) can be in S1020 shade level (indicated as reference 27) or S6030 shade level (indicated as reference 28), which is at least three shade levels apart. That is, a shade code of one of the two sub-yarns 122 (123) is S1050-Y90R, and a shade code of the other of the two sub-yarns 123 (122) is S1020-Y90R or S6030-Y90R. In other words, if a shade level of one of the two sub-yarns 122 (123) is selected to be in S1050 shade level (indicated as reference 26) of the shade triangle 25 of the NSS shown in FIG. 3, and since a shade level of the other one of the two sub-yarns 123 (122) needs to be at least three shade levels apart, the invention must exclude selection of S1070, S1060, S1040, S1030, S2060, S2050, S2040, S2030, S3050, S3040 and S3030 shade levels (the above 11 shade levels are not referenced in FIG. 3). In another embodiment, as shown in FIG. 2, if the two sub-yarns 122, 123 respectively belong to different shade hues, a shade hue angle 29 (30) is formed between two shade hues, and the shade hue angle 29 (30) must be greater than or equal to 30 degrees. For example, if one of the two sub-yarns 122 (123) is selected to be in Y10R hue, for the other one of the two sub-yarns 123 (122), selection of shade hues is excluded from the shade hue angle 29 between Y10R and Y50R, or the shade hue angle 30 between Y10R and G70Y. In addition, in one embodiment, shades of the two sub-yarns 122, 123 are not similar to a shade of the first yarn 111. Specifically, if the two sub-yarns 122, 123 and the first yarn 111 belong to a same shade hue in the NSS, the two sub-yarns 122, 123 must be separated from the first yarn 111 by at least three shade levels respectively. Alternatively, if the two sub-yarns 122, 123 and the first yarn 111 are respectively located on different shade hues, an included angle between any two shade hues will be greater than or equal to 30 degrees.

In one embodiment, in order to prevent a case where the two sub-yarns 122, 123 absorb light to cause the anti-counterfeiting feature 13 cannot be identified by an identification module when images of the two sub-yarns 122, 123 are captured by a camera unit (not shown in the figures) of the identification module, shades of the two sub-yarns 122, 123 are set not to be absolute black. In addition, in order to prevent a case where the two sub-yarns 122, 123 generate a large amount of light reflection during an image capturing process to cause the two sub-yarns 122, 123 cannot be identified by the identification module, the two sub-yarns 122, 123 are set not to be reflective yarns or metal yarns that produce a large amount of light reflection. In a similar way, since white produces a large amount of light reflection after projected by light, shades of the two sub-yarns 122, 123 set not to be absolute white or gray mixed with absolute white and absolute black in proportion.

Please refer to FIG. 1, FIG. 2, FIG. 3, and FIG. 4 for further explanation of the method 70 for forming the anti-counterfeiting feature 13 during knitting. The method 70 is implemented by any one of the aforementioned knitting machines. The method 70 comprises the following steps:

step 71: knitting with the first yarn 111 to produce the fabric 10 by the knitting machine;

step 72: feeding the second yarn 121 when the knitting machine knitting to a position where the anti-counterfeiting feature 13 is predetermined to form on the fabric 10; and step 73: stopping to feed the second yarn 121 and continuing to knit with the first yarn 111 to produce the fabric 10 when the knitting machine knitting beyond the position where the anti-counterfeiting feature 13 is predetermined to form on the fabric 10.

Specifically, at the beginning, the first yarn 111 is knitted by the knitting machine to form the plurality of yarn loops 11 of the fabric 10. Then when the knitting machine knits the position where the anti-counterfeiting feature 13 is predetermined to form, the first yarn 111 is no longer to be fed but instead the second yarn 121; Or, when the knitting machine knits the position where the anti-counterfeiting feature 13 is predetermined to form, the second yarn 121 is further fed together with the first yarn 111 by the knitting machine; Or when the knitting machine knits the position where the anti-counterfeiting feature 13 is predetermined to form, the second yarn 121 is further embedded with the first yarn 111 by the knitting machine (such as the features revealed in U.S. Pat. No. 9,644,291B1). Thereby the fabric 10 directly forms the anti-counterfeiting feature 13 at the position where the anti-counterfeiting feature 13 is predetermined to be formed, and namely the fabric 10 shows the anti-counterfeiting feature 13 on the surface. Furthermore, since the second yarn 121 can be formed by twisting the two sub-yarns 122, 123, a shade of the second yarn 121 exposed on one side surface varies randomly. After that, entering step 73, when the knitting machine knitting beyond the position where the anti-counterfeiting feature 13 is predetermined to form, the knitting machine stops feeding the second yarn 121 and continues to knit with the first yarn 111.

In summary, the invention uses the knitting machine to form the featured yarn loops 12 via techniques such as changing yarn jacquard during a knitting process, so that the anti-counterfeiting feature 13 is directly formed on the fabric 10 during knitting. Also, the invention uses a randomness of the second yarn 121 generated by twisting the two sub-yarns 122, 123 to make the sahde of each of the featured yarn loops 12 on the fabric 10 be distributed in random, thereby an anti-counterfeiting effect is achieved the uniqueness in random generated by the aforementioned method. Here, it is more difficult to forge because the anti-counterfeiting feature is a structure of the fabric itself.

Besides, the present invention is not limited to the above embodiments that the featured yarn loops are formed in a straight strip pattern, and can be realized by various forms according to designs. In one embodiment, a width 131 of the anti-counterfeiting feature 13 is greater than or equal to 1 inch.

Furthermore, in one embodiment, considering the tensions of the first yarn 111 and the second yarn 121, the first yarn 111 and the second yarn 121 will cause the fabric 10 shrinking after knitting. In order to prevent the anti-counterfeiting feature 13 from being too small to recognize due to the shrinkage, a needle pitch setting range of the knitting machine is set between 5 G and 20 G; that is, a needle pitch of the knitting machine is 5 to 20 stitches per inch. In this way, a width 132 of each of the featured yarn loops 12 knitted by the knitting machine can still be greater than or equal to 1 mm under taking subjected tension effect, so that the anti-counterfeiting feature 13 can be distinguished easily.

What is claimed is:

1. A method for forming an anti-counterfeiting feature during knitting of a fabric comprising steps of:

knitting with at least one first yarn to produce a fabric by a knitting machine;

feeding a second yarn when the knitting machine knitting to a position where the anti-counterfeiting feature is predetermined to form on the fabric, wherein the second yarn is formed by twisting at least two sub-yarns with dissimilar colours, and colours of the at least two sub-yarns and the first yarn are not similar to each other, and wherein a plurality of featured yarn loops formed by the second yarn is observed on one side surface of the fabric at the position to constitute the anti-counterfeiting feature, and a colour of the plurality of featured yarn loops displayed on the side surface is random; and stopping to feed the second yarn and continuing to knit with the first yarn to produce the fabric when the knitting machine knitting beyond the position where the anti-counterfeiting feature is predetermined to form on the fabric.

2. The method for forming the anti-counterfeiting feature during knitting of the fabric as claimed in claim 1, wherein the at least two sub-yarns belong to a same colour hue of a natural colour system and are at least three colour levels apart.

3. The method for forming the anti-counterfeiting feature during knitting of the fabric as claimed in claim 1, wherein the at least two sub-yarns respectively belong to different two colour hues of a natural colour system, a colour hue angle is formed between two colour hues, and wherein the colour hue angle is greater than or equal to 30 degrees.

4. The method for forming the anti-counterfeiting feature during knitting of the fabric as claimed in claim 3, wherein colours of the at least two sub-yarns are not absolute white, absolute black, or gray mixed with absolute black and absolute white in proportion.

5. The method for forming the anti-counterfeiting feature during knitting of the fabric as claimed in claim 4, wherein the at least two sub-yarns are not reflective yarns.

6. The method for forming the anti-counterfeiting feature during knitting of the fabric as claimed in claim 2, wherein the at least one first yarn and the at least two sub-yarns belong to the same colour hue of the natural colour system, and the at least one first yarn and the at least two sub-yarns are separated by at least three colour levels respectively.

7. The method for forming the anti-counterfeiting feature during knitting of the fabric as claimed in claim 2, wherein the at least one first yarn belongs to a colour hue of the natural colour system, which is different from the same colour hue of the at least two sub-yarns, a colour hue angle is formed between two colour hues, and the colour hue angle is greater than or equal to 30 degrees.

8. The method for forming the anti-counterfeiting feature during knitting of the fabric as claimed in claim 7, wherein a width of the anti-counterfeiting feature is greater than or equal to 1 inch.

9. The method for forming the anti-counterfeiting feature during knitting of the fabric as claimed in claim 8, wherein a needle pitch setting range of the knitting machine is set between 5 G and 20 G.

10. The method for forming the anti-counterfeiting feature during knitting of the fabric as claimed in claim 9, wherein the plurality of featured yarn loops are arranged to form at least one straight strip pattern on the fabric.

11. A fabric formed with an anti-counterfeiting feature during knitting, wherein the fabric is knitted with at least one first yarn, the fabric characterized in that:

a part of the fabric includes a plurality of featured yarn loops formed by a second yarn, the plurality of featured yarn loops constitutes the anti-counterfeiting feature, which is directly observed from one side surface of the fabric, the second yarn is formed by twisting at least two sub-yarns with dissimilar colours, and colours of the at least two sub-yarns and the first yarn are not similar to each other, and a colour of the plurality of featured yarn loops displayed on the side surface is random.

12. The fabric formed with the anti-counterfeiting feature during knitting as claimed in claim 11, wherein the at least two sub-yarns belong to a same colour hue of a natural colour system and are at least three colour levels apart.

13. The fabric formed with the anti-counterfeiting feature during knitting as claimed in claim 11, wherein the at least two sub-yarns respectively belong to different two colour hues of a natural colour system, a colour hue angle is formed between two colour hues, and wherein the colour hue angle is greater than or equal to 30 degrees.

14. The fabric formed with the anti-counterfeiting feature during knitting as claimed in claim 13, wherein colours of the at least two sub-yarns are not absolute white, absolute black, or gray mixed with absolute white and absolute black in proportion.

15. The fabric formed with the anti-counterfeiting feature during knitting as claimed in claim 14, wherein the at least two sub-yarns are not reflective yarns.

16. The fabric formed with the anti-counterfeiting feature during knitting as claimed in claim 11, wherein the at least one first yarn and the at least two sub-yarns belong to a same colour hue of a natural colour system, and the at least one first yarn and the at least two sub-yarns are separated by at least three colour levels respectively.

17. The fabric formed with the anti-counterfeiting feature during knitting as claimed in claim 12, wherein when the at least one first yarn and the at least two sub-yarns belong to the same colour hue of the natural colour system, the at least one first yarn and the at least two sub-yarns are separated by at least three colour levels respectively.

18. The fabric formed with the anti-counterfeiting feature during knitting as claimed in claim 12, wherein the at least one first yarn belongs to a colour hue of the natural colour system, which is different from the same colour hue of the at least two sub-yarns, a colour hue angle is formed between two colour hues, and the colour hue angle is greater than or equal to 30 degrees.

19. The fabric formed with the anti-counterfeiting feature during knitting as claimed in claim 18, wherein a width of the anti-counterfeiting feature is greater than or equal to 1 inch.

20. The fabric formed with the anti-counterfeiting feature during knitting as claimed in claim 19, wherein a width of each of the plurality of featured yarn loops displayed on the side surface is greater than or equal to 1 mm.

* * * * *